US008387251B2

(12) United States Patent
Beppu

(10) Patent No.: US 8,387,251 B2
(45) Date of Patent: Mar. 5, 2013

(54) PRODUCTION METHOD OF INTERNALLY RIBBED STEEL TUBE

(75) Inventor: Kenichi Beppu, Wakayama (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 403 days.

(21) Appl. No.: 12/761,009

(22) Filed: Apr. 15, 2010

(65) Prior Publication Data

US 2010/0193171 A1 Aug. 5, 2010

Related U.S. Application Data

(63) Continuation of application No. PCT/JP2008/068216, filed on Oct. 7, 2008.

(30) Foreign Application Priority Data

Oct. 17, 2007 (JP) ..... 2007-269606

(51) Int. Cl.
*B21D 53/06* (2006.01)
*B23P 15/26* (2006.01)
*B21C 1/24* (2006.01)

(52) U.S. Cl. ..... 29/890.049; 29/890.05; 29/890.053; 72/370.17; 72/283; 72/209; 72/31.03; 72/365.2; 165/179

(58) Field of Classification Search ..... 29/809.048, 29/890.049, 890.05, 890.051, 890.053, 33 D; 72/283, 209, 208, 370.17, 367.1, 368, 370.01, 72/370.16, 370.21, 370.24, 31.03, 31.06; 165/179
See application file for complete search history.

(56) References Cited

U.S. PATENT DOCUMENTS

| | | | | |
|---|---|---|---|---|
| 4,876,869 | A * | 10/1989 | Saeki et al. | 72/68 |
| 6,834,523 | B2 * | 12/2004 | Hinago et al. | 72/206 |
| 7,371,293 | B2 * | 5/2008 | Nakashima et al. | 148/333 |
| 2003/0182979 | A1 | 10/2003 | Hinago et al. | |

FOREIGN PATENT DOCUMENTS

| | | |
|---|---|---|
| JP | 62-237295 | 10/1987 |
| JP | 7-275977 | 10/1995 |
| JP | 2001-179327 | 7/2001 |
| JP | 2003-290816 | 10/2003 |
| JP | 2006-272392 | 10/2006 |

* cited by examiner

*Primary Examiner* — Sarang Afzali
(74) *Attorney, Agent, or Firm* — Clark & Brody

(57) ABSTRACT

There is provided a production method of an internally ribbed steel tube, capable of forming spiral ribs stably so as to reduce troubles at the time of cold drawing for forming the spiral ribs of the steel tube. In this production method, the spiral ribs can be formed stably so as to reduce troubles at the time of cold drawing for forming the spiral ribs by straightening bends of a blank tube before the cold drawing for forming the spiral ribs, by optimizing the direction of the spiral rib formation after the bend straightening, and by correcting the drawing schedule depending on the blank tube. The obtained internally ribbed steel tube is well applicable to an increased capacity and a higher temperature/higher pressure operation of a boiler because the steel tube is provided with high formability and excellent quality as a boiler steel tube.

2 Claims, 3 Drawing Sheets

*1: Performed as necessary

*2: Essential step when seamless steel tube is used as blank tube

PRODUCTION METHOD OF INTERNALLY RIBBED STEEL TUBE

This application is a continuation of International Patent Application No. PCT/JP2008/068216, filed Oct. 7, 2008. This PCT application was not in English as published under PCT Article 21(2).

TECHNICAL FIELD

The present invention relates to a production method of an internally ribbed steel tube, which is used to form spiral ribs (protrusions) on the internal surface of a steel tube by cold drawing, and the internally ribbed steel tube. More particularly, the invention relates to a production method of an internally ribbed steel tube, which can form spiral ribs stably, and an internally ribbed steel tube produced by using the method.

BACKGROUND ART

Usually, for a high temperature heat resistant part of a boiler, a heat exchanger, or the like, an internally ribbed steel tube (rifled tube) with spiral ribs (protrusions) formed on the internal surface of the steel tube is used to improve a power generation efficiency. Since the internal surface of the internally ribbed steel tube has a larger surface area by the ribs formed on the internal surface, a contact area between water vapor passing through the inside of heated tube and the internal surface of the tube increases, while allowing turbulence to occur in a fluid containing water vapor, thereby enabling a heat exchange efficiency to be enhanced. With a recent tendency of increased capacity and higher temperature/higher pressure of the boiler, the demand for the internally ribbed steel tube has increased rapidly.

To produce the internally ribbed steel tube, a seamless steel tube or an electric resistance welded steel tube is used as a blank tube, the blank tube is sufficiently softened as necessary, and then in a cold working process a drawing die and a plug, which has spiral grooves on its outer peripheral surface for forming ribs for the tube, are used to draw the tube.

FIG. 1 is an explanatory view for schematically illustrating a production method of an internally ribbed steel tube by cold drawing. When a blank tube 3 is cold drawn, a plug 1 is inserted into the blank tube 3 in a concentric manner relative to a die 2 and the blank tube 3, and the blank tube 3 is drawn in the direction indicated by a hollow arrow while allowing the plug 1 to be rotated. The external surface of blank tube 3 is reduced by the die 2. The internal surface of the blank tube 3 is pressed into and processed along spiral grooves 1*a* made on the outer peripheral surface of the plug 1 so that spiral ribs 3*a* are formed on the inner peripheral surface of the drawn blank tube 3.

The plug 1 thus used can be rotated freely, and is held by a mandrel 4. The plug shape greatly affects qualities such as rib height and rib shape (especially, rib corner part and lead angle) of the internally ribbed steel tube, and the seizure defective occurs between the blank tube and the plug depending on drawing conditions.

Therefore, regarding the production of internally ribbed steel tube, various proposals have conventionally been made on the configuration and shape of the plug. For example, Japanese Patent Application Publication No. 2001-179327 proposes a plug in which in a spiral groove thereof, the radius of curvature for each of corner portions where both groove side walls intersect a groove bottom surface is kept constant all the way from the front end of the plug to the rear end thereof, and the diameter of the plug is decreased at a fixed gradient from the front end of the plug toward the rear end thereof.

Also, Japanese Patent Application Publication No. 2006-272392 has disclosed a drawing tool for drawing the internally ribbed steel tube, in which edges of each spiral groove ridge are rounded or chamfered linearly to reduce the area of contact between the top land part of groove ridge and the blank tube, thereby reducing frictional resistance between the groove ridge top part and the blank tube.

DISCLOSURE OF THE INVENTION

In the aforementioned publications, by using the plugs disclosed, the occurrence of seizure defective can be prevented when the blank tube for the internally ribbed steel tube is cold drawn, and the plug itself can be manufactured relatively easily and inexpensively, so that the production cost of the internally ribbed steel tube can be reduced significantly.

However, regardless of shape or configuration of plug, cold drawing a bent blank tube to form spiral ribs causes many troubles due to the bends of the blank tube. Further, even cold drawing the blank tube whose bends have been straightened to form the spiral ribs may cause many drawing troubles depending on the direction/orientation of the spiral ribs to be formed.

Either a seamless steel tube or an electric resistance welded steel tube can be used as the blank tube for the internally ribbed steel tube. In the case where the seamless steel tube is used as the blank tube, it is desirable to perform cold drawing for correcting the cross section along a tube axis direction of the blank tube to a substantially true circle form (hereinafter, referred to as "circle finish drawing") before the rib-forming cold drawing. Thereby, the formability of blank tube and the accuracy of internally ribbed steel tube can be improved remarkably.

The present invention has been made in view of the above-described circumstances at a time when the internally ribbed steel tube is cold drawn, and accordingly an object thereof is to provide a production method of an internally ribbed steel tube, in which spiral ribs can be formed stably so as to reduce troubles at the time of rib-forming cold drawing by straightening bends of a blank tube before the rib-forming cold drawing, by optimizing the direction/orientation of forming the spiral ribs in the case where the spiral ribs are formed on the internal surface of blank tube whose bends have been straightened, and by adjusting the drawing schedule depending on the kinds of blank tubes to be used, and an internally ribbed steel tube produced by using this method.

The present invention has been made to solve the above-described problems, and the gist thereof consists in production methods of an internally ribbed steel tube as described in the following items (1) to (3) and an internally ribbed steel tube as described in the item (4).

(1) A production method of an internally ribbed steel tube, including the steps of: straightening bends of a blank tube for an internally ribbed steel tube; and cold drawing the blank tube to form spiral ribs.

(2) In the production method of an internally ribbed steel tube described in the above item (1), it is preferable that in the step of cold drawing the blank tube to form the spiral ribs, the spiral ribs be formed in a direction parallel to or substantially parallel to a high-hardness zone formed spirally on the internal surface of the blank tube in the step of straightening the bends of the blank tube for the internally ribbed steel tube.

(3) In the production method of an internally ribbed steel tube described in the above item (1), it is preferable that when a seamless steel tube is used as the blank tube for the internally ribbed steel tube, the seamless steel tube to be used as the blank tube be cold drawn at least once to correct its cross section along a tube axis direction to a substantially true circle form before the step of rib-forming cold drawing.

(4) An internally ribbed steel tube in which spiral ribs are formed in a direction parallel to or substantially parallel to a high-hardness zone formed spirally in the step of straightening bends of the blank tube for the internally ribbed steel tube. When a seamless steel tube is used as the blank tube, it is preferable that the internally ribbed steel tube be produced by a production method including the step of cold drawing at least once for the blank tube to perform a circle finish process to correct its cross section along a tube axis direction to a circle form before a step of straightening bends of the blank tube.

The "high-hardness zone" defined in the present invention is a work-hardened zone formed on the internal surface of the blank tube by a crush load, which makes compressive stress in a diameter-wise direction, applied to the blank tube between straightening rolls on condition that a roll straightening system is used. The zone is a hard-to-work area which is low in ductility and toughness, and is susceptible to rupture.

According to the production method of an internally ribbed steel tube in accordance with the present invention, the spiral ribs can be formed stably so as to suppress troubles at the time of cold drawing for forming the spiral ribs by straightening bends of blank tube before such rib-forming cold drawing, by optimizing the orientation of spiral rib formation after the bend straightening, and by adjusting the drawing schedule depending on the kinds of the blank tubes to be used. The internally ribbed steel tube thus obtained exhibits excellent formability and quality.

BEST MODE FOR CARRYING OUT THE INVENTION

Figure 2:
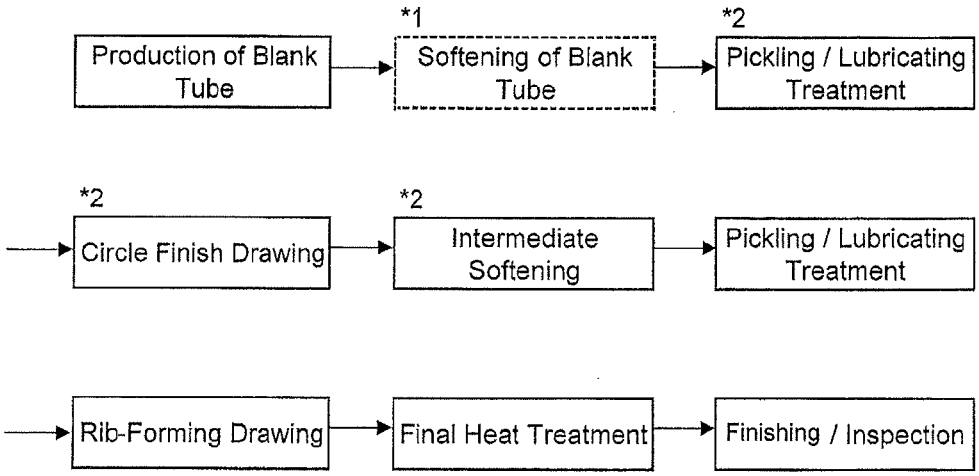
FIG. 2 is a block diagram showing a process example applicable to a production method of an internally ribbed steel tube in accordance with the present invention.

FIG. 2 is a block diagram showing a process example applicable to a production method of an internally ribbed steel tube in accordance with the present invention. Types of steels used for the internally ribbed steel tube in accordance with the present invention are carbon steel and Cr-based low-alloy steel (for example, STBA22, 1Cr-1/2Mo steel), and a seamless steel tube or an electric resistance welded steel tube can be used as a blank tube.

Usually, the seamless steel tube is produced by hot rolling using a mandrel mill tube-making method for its high production efficiency. The electric resistance welded steel tube is produced by an electric resistance welding process incorporating technologies of an inert-gas shielded arc welding and automatically controlling the welding heat input so as to prevent the oxidation of weld zone and to stabilize the weld bead.

At the stage of producing a blank tube, it is decided according to the steel type and production conditions of blank tube whether blank tube softening treatment is required. Next, the blank tube for the internally ribbed steel tube is descaled by pickling, immediately after being softened or even in case without the softening treatment, to remove scale on the internal and external surfaces of the blank tube, and is subjected to lubricating treatment.

Usually, for the blank tube of the steel type to which the present invention is directed, sulfuric acid pickling is performed for descaling, and chemical treatment by phosphate treatment (zinc phosphate etc.) is performed for lubricating treatment. The specific procedure for pickling/lubricating treatment is as follows: after descaling, the internal and external surfaces of blank tube are cleaned by using an alkaline degreasing agent and rinsed, and the rinsed blank tube is immersed in a phosphate treatment bath to form a phosphate substrate on the internal and external surfaces. Next, neutralization treatment is performed, and after soap treatment using sodium stearate as principal component, the blank tube is dried using hot air. In the above-described procedure, the lubricating treatment is performed in a humidified state to promote the treatment effect.

Figure 1:
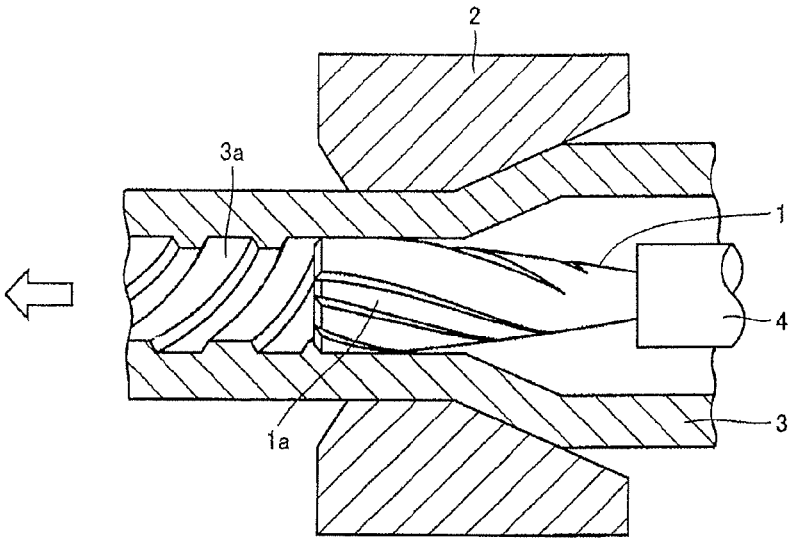
FIG. 1 is an explanatory view for schematically illustrating a production method of an internally ribbed steel tube by cold drawing.

In cold drawing for forming spiral ribs (hereinafter, sometimes referred to as "rib-forming drawing"), as shown in FIG. 1, a plug is inserted into the blank tube, and a drawing process is effected with the plug in a rotatable state, whereby the external surface of blank tube is reduced by a die, and spiral ribs are formed on the inner peripheral surface of the blank tube.

As in the process example shown in FIG. 2, the steel tube with the spiral ribs formed by cold drawing is subjected to final heat treatment and finishing treatment, and qualities such as rib height and rib shape are checked in an inspection step to thereby yield an internally ribbed steel tube product.

The production method of an internally ribbed steel tube in accordance with the present invention is characterized by the straightening of bends of blank tube prior to a rib-forming cold drawing. In other words, by straightening the bends before the cold drawing, drawing troubles are reduced, and the spiral ribs can be formed stably.

Generally, as a roll straightening machine used to straighten bends of blank tube, a cross roll straightening machine in which a plurality of hourglass- or gourd-like rolls are combined is adopted. In the cross roll straightening machine, there are a large number of configurations depending on combinations of the number, disposition (vertical, horizontal), and arrangement (opposed type, zigzag type) of rolls. As the straightening machine for straightening bends of blank tube, there is used a cross roll straightening machine of the opposed type arrangement in which a pair of rolls are arranged in a manner opposed to each other.

Figure 3:
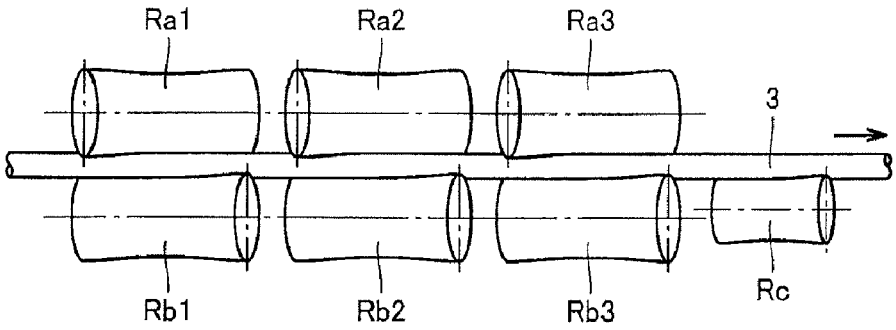
FIG. 3 is a diagram showing an example of roll arrangement of a cross roll straightening machine.

FIG. 3 is a diagram showing an example of roll arrangement of the cross roll straightening machine. In the roll straightening machine, there are disposed a plurality of pairs in which each one consists of straightening rolls Ra, Rb arranged vertically opposedly, i.e., in a manner opposed to each other, while allowing the axis of rotation thereof to be intersected/crossed with each other in a horizontal view. For the roll arrangement shown in the figure, three pairs of straightening rolls Ra1 and Rb1, Ra2 and Ra2, and Ra1 and Rb3, at the entrance side, at the center, and at the delivery side, respectively, are arranged opposedly, and an auxiliary roll Rc is provided at the exit of the delivery-side straightening rolls. Usually, the roll straightening machine having such a roll arrangement is called a (2-2-2-1) type straightening machine.

The opening space between and intersection angle of the pair of straightening rolls Ra1, Rb1 can be adjusted individually. Further, height positions of the pair of straightening rolls Ra1, Rb1 and the adjacent pair of straightening rolls Ra2, Rb2 can also be adjusted individually.

In straightening bends, the roll angle is adjusted so that the surface of the blank tube 3 follows along the surface contour of the straightening roll, the opening space between the straightening rolls Ra1, Rb1 is set so as to be slightly smaller than the outside diameter of the blank tube 3, thereby applying a crush load, and the height positions (crush heights) of the adjacent pair of straightening rolls Ra2, Rb2 are adjusted, whereby the bends of the blank tube 3 are straightened.

The benefits of performing straightening of the bends of blank tube before rib-forming cold drawing is that, when the plug and a mandrel are first inserted into the blank tube at the preparatory stage of cold drawing, a gap can be secured between the internal surface of blank tube and the plug and mandrel since the blank tube is sufficiently straight, so that the exfoliation of lubricant adhered to the internal surface and the occurrence of scratches can be suppressed. Therefore, drawing troubles are reduced, and the spiral ribs can be formed stably.

If a bent blank tube is cold drawn, an excessive stress develops locally. That is to say, since the stress caused at the inside of the bend is higher than the stress caused at the outside of the bend, unevenness occurs in wall thickness such that the wall thickness on the inside of the bend is smaller than that on the outside thereof. Therefore, by straightening bends of blank tube before cold drawing, drawing troubles are reduced, and the quality characteristics and dimensional characteristics of the formed spiral ribs can be improved.

The production method of an internally ribbed steel tube in accordance with the present invention is characterized by the formation of the spiral ribs in a direction parallel to or substantially parallel to a high-hardness zone formed spirally by the straightening of the bends. As described above, in the straightening of the bends of blank tube, the opposedly arranged roll straightening machine is used. At this time, the bends are straightened by a crush load applied to the blank tube. By the application of the crush load, the spiral high-hardness zone is formed throughout the entire length of the straightened blank tube.

Figure 4:
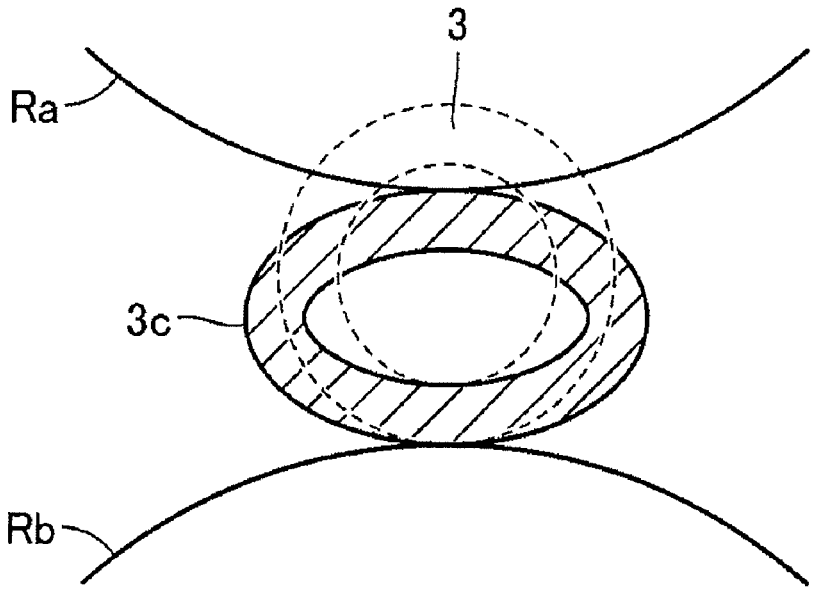
FIG. 4 is an explanatory view for explaining a crush load of a cross roll straightening machine in which a pair of rolls are arranged opposedly, i.e., in a manner opposed to each other.

FIG. 4 is an explanatory view for explaining the crush load of the opposedly arranged roll straightening machine. Due to roll straightening, the blank tube 3 becomes elliptic 3*c* in a cross-sectional view. The crush load is applied to the overall length of the blank tube 1 which moves while being turned. Therefore, the blank tube is straightened while allowing the spiral high-hardness zone to be formed.

Figure 5:
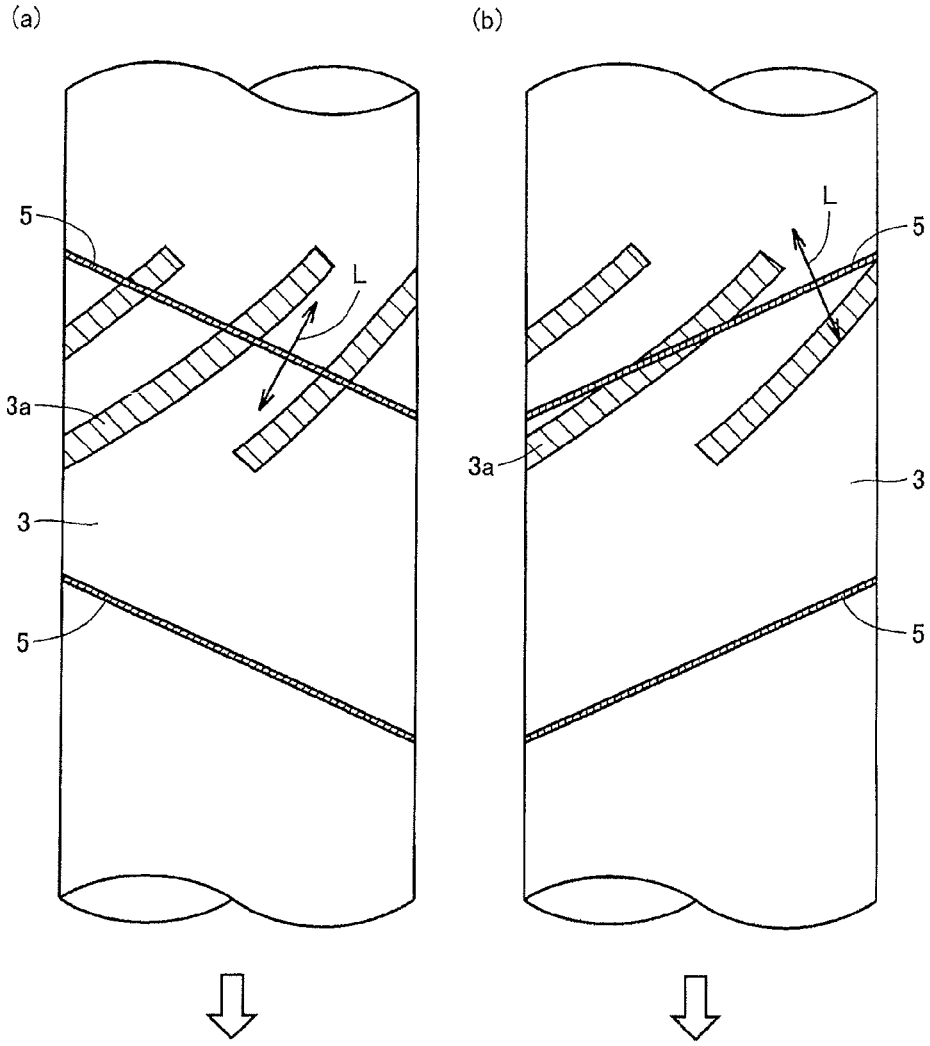
FIG. 5 is side views showing the relationship between a spiral high-hardness zone formed by the straightening of bends and the direction/orientation of spiral rib formation on the internal surface of a blank tube, FIG. 5(*a*) showing the case where the spiral high-hardness zone and the direction of spiral rib formation on the internal surface of the blank tube intersect at right angle, and FIG. 5(*b*) showing the case where the spiral high-hardness zone and the direction of spiral ribs on the internal surface of the blank tube are parallel to each other.

FIG. 5 is side views showing the relationship between the spiral high-hardness zone formed by straightening of bends and the direction/orientation of the spiral rib formation on the internal surface of the blank tube, FIG. 5(*a*) showing the case where the spiral high-hardness zone and the direction of the spiral rib formation on the internal surface of the blank tube intersect at right angle, and FIG. 5(*b*) showing the case where the spiral high-hardness zone and the direction of the spiral rib formation on the internal surface of the blank tube are parallel to each other. In FIG. 5, the hollow arrow indicates a drawing direction.

When the spiral ribs are formed by cold drawing, a reduction rate of a rib part 3*a* becomes the highest. On the other hand, as indicated by the arrow L in FIGS. 5(*a*) and 5(*b*), in a direction intersecting at right angle with and abruptly striding over a high-hardness zone 5, the ductility and toughness deteriorate remarkably, and the blank tube is more susceptible to rupture during the course of cold drawing.

Therefore, in the case where the high-hardness zone 5 and the direction of the spiral rib 3*a* formation on the internal surface of the blank tube intersect at right angle as shown in FIG. 5(*a*), the working stress is exerted along the direction in which the ductility and toughness deteriorate, so that the blank tube is more susceptible to rupture during the course of cold drawing.

On the other hand, in the case where the high-hardness zone 5 and the direction of the spiral rib 3*a* formation on the internal surface of the blank tube are parallel to each other as shown in FIG. 5(*b*), the application of working stress along the direction in which the ductility and toughness deteriorate can be avoided, so that the rupture does not occur even if cold drawing is performed, and the spiral ribs can be formed stably.

The definition of "the direction parallel to or substantially parallel to a high-hardness zone" in the present invention does not mean that the intersection of the high-hardness zone 5 and the orientation of spiral rib 3*a* formation on the internal surface of the blank tube is avoided, and at least means to eliminate such a configuration that the high-hardness zone 5 and the orientation of the spiral rib 3*a* formation on the internal surface of the blank tube should intersect at right angle as shown in FIG. 5(*a*), and the working stress should be applied along the direction in which the ductility and toughness deteriorate.

In the production method of an internally ribbed steel tube in accordance with the present invention, in the case where a seamless steel tube is used as the blank tube, the circle finish drawing must be performed at least once before the spiral ribs are formed by cold drawing. This "circle finish drawing" does not include so-called sinking process using a die only, but means cold drawing using a die and plug.

As described above, the seamless steel tube used as the blank tube for the internally ribbed steel tube is produced by hot rolling using the mandrel mill tube-making method. Usually, in the mandrel mill tube-making method, elongation rolling using a mandrel mill is performed after piercing-rolling, and diameter adjustment rolling using a stretch reducer or the like is performed. In the diameter adjustment rolling, the blank tube is reduced in diameter by a rolling process and longitudinal stripe shaped wrinkle flaws or angular projections are likely to occur in a longitudinal direction of the internal surface of tube because a tool that constrains the internal surface of tube is not used.

Therefore, by subjecting the blank tube to the circle finish drawing at least once to improve the wrinkle depth and angular projection on the internal surface, troubles are reduced at the time of cold drawing for forming the spiral ribs, so that the spiral ribs can be formed stably.

Regarding the improvement in the wrinkle depth and angular projection due to cold drawing, the working rate of wall thickness may have a great influence. Therefore, in the circle finish drawing, it is desirable to keep the working rate of wall thickness at 10% or more. The working rate of wall thickness in cold drawing is expressed as {(wall thickness of blank tube−wall thickness after cold drawing)/wall thickness of blank tube}×100(%).

Since the blank tube is work hardened by the circle finish drawing of blank tube, to eliminate troubles of cold drawing for forming the spiral ribs, it is desirable to heat-treat the blank tube after the circle finish drawing and to perform the rib-forming drawing after the blank tube has been softened sufficiently.

The internally ribbed steel tube in accordance with the present invention can be obtained by the above-described production method, and is characterized in that a plurality of stripes of spiral ribs are formed along ae tube axis direction by cold drawing on the internal surface of the blank tube whose bends have been straightened, and moreover the spiral ribs are formed in a direction parallel to or substantially parallel to the high-hardness zone formed spirally by straightening bends.

The internally ribbed steel tube in accordance with the present invention can cope with the increased capacity and the operation under higher temperature/higher pressure for a boiler because the steel tube is provided with high formability and excellent quality as a boiler steel tube.

EXAMPLES

Example 1

To confirm the effect of the production method of an internally ribbed steel tube in accordance with the present invention, ten lengths of internally ribbed steel tubes each having four stripes of internal spiral ribs were produced for each of Inventive Examples and Comparative Examples. The blank tube was produced by cold drawing using a seamless steel tube whose steel type was JIS STBA22 (1Cr-1/2Mo steel), wherein a series of processes: blank tube softening—pickling/lubricating treatment—circle finish drawing—softening were applied.

The drawing schedule was such that the blank tube dimensions were 38.0 mm in outside diameter and 8.2 mm in wall thickness, the dimensions after the circle finish drawing were 32.0 mm in outside diameter and 7.2 mm in wall thickness, and the final dimensions after cold drawing were 28.6 mm in outside diameter, 6.0 mm in wall thickness, and 0.8 mm in rib depth. The pickling/lubricating treatment consisted of sulfuric acid pickling, zinc phosphate coating, and sodium stearate soap treatment for all the tubes.

In present Inventive Example 1, after the circle finish drawing, the bends of blank tube was straightened by using an opposedly arranged cross roll straightening machine, and the spiral ribs were formed by cold drawing. In the cold drawing at this time, no seizure defective occurred for any tube.

In Comparative Example 1, the spiral ribs were formed by cold drawing without the straightening of bends after the circle finish drawing. In this case, the seizure defective occurred frequently. Even if the seizure defective did not occur, wall eccentricity occurred remarkably.

Example 2

Internally ribbed steel tubes each with four stripes of spiral ribs were produced by cold drawing under the same conditions as those of Example 1.

In the Invention Example 2, after the circle finish drawing, the bends of blank tube were straightened by using the opposedly arranged cross roll straightening machine, and the spiral ribs were formed by cold drawing along a direction parallel to the high-hardness zone formed spirally by the bend straightening as shown in FIG. 5(*b*). In the cold drawing at this time, the seizure defective did not occur for any tube.

In Comparative Example 2, after the circle finish drawing, the bends of blank tube were straightened by using the opposedly arranged cross roll straightening machine, and the spiral ribs were formed by cold drawing along a direction intersecting at right angle with the high-hardness zone formed spirally by the bend straightening as shown in FIG. 5(*a*). At this time, the seizure defective occurred frequently in a rib portion intersecting at right angle with the high-hardness zone, and further cracking occurred sometimes in the rib portion.

Example 3

For comparison of drawing schedule in the production method of an internally ribbed steel tube in accordance with the present invention, ten lengths of internally ribbed steel tubes each having four stripes of spiral ribs were manufactured for each of Invention Examples and Comparative Examples. The blank tube was produced by cold drawing using an electric resistance welded steel tube and seamless steel tube whose steel type was JIS STBA22 (1Cr-1/2Mo steel).

The drawing schedule was such that the blank tube dimensions were 38.0 mm in outside diameter and 7.2 mm in wall thickness. The internally ribbed steel tube with four stripes of spiral ribs was produced by cold drawing without the circle finish drawing. Other conditions were the same as those of Example 1.

In Inventive Example 3, the spiral ribs were formed by cold drawing using the electric resistance welded steel tube without the circle finish drawing. In the cold drawing at this time, the seizure defective did not occur for any tube.

In Comparative Example 3, the spiral ribs were formed by cold drawing using the seamless steel tube without the circle finish drawing. In the cold drawing at this time, the seizure defective occurred frequently due to longitudinal stripe shaped wrinkle flaws or angular projections on the blank tube.

Example 4

To verify the influences of processing steps and working condition in the production method of an internally ribbed steel tube in accordance with the present invention on the occurrence of the seizure defective in cold drawing, four stripes of spiral ribs were formed by cold drawing using a seamless steel tube whose steel type was JIS STBA22 (1Cr-1/2Mo steel) as the blank tube. For the influences of processing steps, the case whether the circle finish drawing was done or not and the case whether the bend straightening was done or not were checked, and the influence of working conditions was examined by changing the rib formation orientation and the depth of the spiral rib.

The cold drawing (Test Nos. 1 to 6) at this time was performed by applying the pickling/lubricating treatment comprising sulfuric acid pickling, zinc phosphate coating, and sodium stearate soap treatment, while varying the rib depth to 0.6 mm, 0.8 mm, and 1.0 mm under a constant finished dimension of outside diameter at 28.6 mm. Five lengths of internally ribbed steel tubes were produced for each of the conditions. The results are given in Table 1. The seizure occurrence was expressed by (number of tubes with seizure/number of drawn tubes). The seizure occurrence of 0/5 and 1/5 were regarded as acceptable.

TABLE 1

| Test No. | Treatment process and working conditions: Circle finish drawing | Bend straightening | Formation direction of spiral rib | Seizure occurrence (number of tubes with seizure/number of drawn tubes) Depth of spiral rib: 0.6 mm | 0.8 mm | 1.0 mm |
|---|---|---|---|---|---|---|
| 1 | Not done | Done | Parallel | 0/5 | 1/5 | 4/5 |
| 2 | Not done | Done | At right angle | 0/5 | 3/5 | 5/5 |
| 3 | Not done | Not done | — | 4/5 | 5/5 | 5/5 |
| 4 | Done | Done | Parallel | 0/5 | 0/5 | 0/5 |
| 5 | Done | Done | At right angle | 0/5 | 1/5 | 5/5 |
| 6 | Done | Not done | — | 0/5 | 0/5 | 4/5 |

Note)

Formation direction/orientation of spiral ribs indicates the relationship with "high-hardness zone" formed by bend straightening.

As is apparent from the results given in Table 1, in the case where a seamless steel tube was used as the blank tube, as in Test No. 4, the seizure occurrence was low and good regardless of the rib depth when the bend straightening was performed after the circle finish drawing, and the spiral ribs were formed by cold drawing along a direction parallel to the "high-hardness zone".

On the other hand, as in Test No. 3, when these spiral ribs were formed by cold drawing without the circle finish drawing and the bend straightening, the seizure defective occurred regardless of the rib depth.

Industrial Applicability

According to the production method of an internally ribbed steel tube in accordance with the present invention, the spiral ribs can be formed stably so as to reduce troubles at the time of cold drawing for forming the spiral ribs by straightening the bends of blank tube before the rib-forming cold drawing, by optimizing the orientation of the spiral rib formation after the bend straightening, and by adjusting the drawing schedule depending on the blank tube.

The obtained internally ribbed steel tube can sufficiently cope with the increased capacity and the higher temperature/higher pressure operation of a boiler and can be used widely because the steel tube is provided with high formability and excellent quality as a boiler steel tube.

What is claimed is:

1. A production method of an internally ribbed steel tube with a plurality of stripes of spiral ribs formed in a tube axis direction, comprising the steps of:

producing a steel tube to be used as a blank tube for the internally ribbed steel tube;

straightening bends of the blank tube; and cold drawing the blank tube to form the spiral ribs, wherein in the step of cold drawing the blank tube to form the spiral ribs, the spiral ribs are formed along a direction parallel to or substantially parallel to a high-hardness zone formed spirally on an internal surface of the blank tube in the step of straightening the bends of the blank tube, for the internally ribbed steel tube.

2. The production method of an internally ribbed steel tube according to claim 1, wherein a seamless steel tube is used as the blank tube, further comprising the step of at least once, cold drawing the blank tube to correct a cross section thereof along a tube axis direction to a substantially true circle form before the step of cold drawing for forming the spiral ribs.

* * * * *